US006942035B2

(12) United States Patent
Sollesnes

(10) Patent No.: US 6,942,035 B2
(45) Date of Patent: Sep. 13, 2005

(54) METHOD AND APPARATUS FOR RETRIEVING EQUIPMENT FROM A WELL

(75) Inventor: Odd Sollesnes, Hauglandshella (NO)

(73) Assignee: Total Catcher Offshore AS, Bergen (NO)

( * ) Notice: Subject to any disclaimer, the term of this patent is extended or adjusted under 35 U.S.C. 154(b) by 0 days.

(21) Appl. No.: 10/169,701

(22) PCT Filed: Jan. 29, 2001

(86) PCT No.: PCT/NO01/00031

§ 371 (c)(1),
(2), (4) Date: Mar. 31, 2003

(87) PCT Pub. No.: WO01/57357

PCT Pub. Date: Aug. 9, 2001

(65) Prior Publication Data

US 2004/0003923 A1 Jan. 8, 2004

(30) Foreign Application Priority Data

Jan. 28, 2000 (NO) ..... 20000473

(51) Int. Cl.[7] ..... E21B 31/08
(52) U.S. Cl. ..... 166/301; 166/99
(58) Field of Search ..... 166/99, 301, 98, 166/54.5, 54.6; 294/86.11, 86.29, 86.32

(56) References Cited

U.S. PATENT DOCUMENTS 1,347,203 A * 7/1920 Borough ..... 294/86.29
1,362,883 A * 12/1920 McMillian et al. ..... 294/86.32
1,393,096 A * 10/1921 Discoll ..... 294/86.32
1,530,253 A * 3/1925 Fox ..... 394/86.29
1,655,644 A * 1/1928 Baker ..... 175/240
2,083,062 A * 6/1937 Hampton ..... 294/68.22
2,124,772 A * 7/1938 Flury ..... 166/99
2,199,298 A * 4/1940 Fisher ..... 166/99
2,384,090 A * 9/1945 Hartsell ..... 166/99
2,550,080 A * 4/1951 Moore ..... 166/99
2,626,829 A * 1/1953 Maxwell et al. ..... 166/301
2,692,160 A * 10/1954 Miller et al. ..... 294/86.29
2,728,599 A * 12/1955 Moore ..... 294/86.11
2,890,756 A * 6/1959 Middleton ..... 166/99
4,545,432 A * 10/1985 Appleton ..... 166/99
4,646,843 A * 3/1987 Vallally ..... 166/372

* cited by examiner

*Primary Examiner*—Hoang Dang
(74) *Attorney, Agent, or Firm*—Francis C. Hand; Carella, Byrne, Bain et al.

(57) ABSTRACT

A method for the retrieval of an object from a well (16) with a tool (30) is described, in which the object, by lowering of the tool (30), is directed into a lower inlet section (40) to a hollow holding area (46) in the tool (30). The method is characterized in that a tool (30) is applied which comprises an inlet section (40) with a barbed section (56), which lets the object pass into the holding area (46), but which prevents the object (22) from being led out of the holding area. A tool that can be used to carry out the method is also described, as well as an application.

4 Claims, 2 Drawing Sheets

METHOD AND APPARATUS FOR RETRIEVING EQUIPMENT FROM A WELL

The present invention relates to a method and a device for retrieving a body from a well with a tool, in which, by lowering of the tool, the body is directed into a lower inlet section of a hollow holding area in the tool. An application is also described.

The invention relates in particular to the retrieval of extended bodies (objects), such as cables/wires/strings and/or cable-/string-hanging fittings from a drilling hole or a well, in which, for example, the fittings block the well as a consequence of the cable- or string breaking.

To carry out logging and other procedures in a well or a drilling hole, which leads down through a formation, with the aid of a suitable instrument, as a rule, the instrument is secured to a cable or wire and lowered down through the drilling hole. However, the instrument can get stuck, so that the cable/wire breaks when attempts are made to pull it up to the surface. Both the instrument and long lengths and bits of cable/wire thereby remain lying/standing down in the drilling hole, and can prevent the further use of this for its intended purposes, something which can be costly for the operator. It is, therefore, necessary to retrieve such remains from the drilling hole.

Different fishing tools for retrieval of such remains are known. These usually include a fishhook-like tool which is lowered down into the well, and one hopes that by appropriate movements, the tool can hook on to the cable (wire) which can then be pulled up. The problem is, however, that the cable can easily break up in even smaller bits/lengths, and only shorter cable lengths may be brought to the surface for each such fishing operation.

It is, therefore, an aim of the present invention to provide a new tool which, in a more effective way than before, can retrieve such cable-hanging fish, i.e. especially the cable which is left behind in the drilling hole. The invention can be used in connection with the operation of drilling holes, both offshore and onshore.

Furthermore, it is an aim to provide a new design for the skirt of such tool and which is made to enclose the length of cable which is to be retrieved.

The method according to the invention is characterised in that a tool is used which includes an inlet section which lets the body pass into the holding area, but which prevents the body from being led out of, i.e. slip out of, the holding area.

According to a preferred embodiment, the tool is conducted in a to- and fro movement, to initially lead the end part of a body (cable/string-remains) in to the inlet, and further to gradually transfer longer and longer lengths of the body via the inlet section to the holding area.

Preferably, a tool is used in which the inlet section comprises a segment with barbs to enable the body to be conducted, in the one direction only, to the holding area. Furthermore, a barbed segment is used in which a number of yielding barbed bodies, with their one end respectively, are arranged mutually separated, parallel with, and alongside the longitudinal axis of the inlet section, while the other end of each yielding barbed body is bent inwards towards the holding area and the longitudinal axis, thereby establishing the mentioned barb effect.

Furthermore, an inlet section comprising a housing with fitted leaf-formed barb body is used, in that the housing is detachable from the tool.

In this way, one achieves a reliable way of ensuring that larger lengths of cable, and the like, partly rigid wires can be caught and brought up to the surface, so that the well is released for further use.

The device according to the invention is characterised in that the inlet section of the tool comprises means which let the body pass into the holding area, but which prevent the body being led out of (slip out of) the holding area.

According to a preferred embodiment, the means comprises an inlet section including a segment with barbs, to make it possible for the body to be directed in only one way into the holding area, and prevent movement in the other direction.

Furthermore, the barbed segment of the inlet comprises a number of yielding barbed organs which, with their one ends respectively, are arranged mutually separated, parallel with, and alongside, the longitudinal axis (X) of the inlet section, while the other end of each yielding body is bent inwards towards the holding area and the longitudinal axis (X), thereby establishing the mentioned barbed effect.

It is also preferred that the inlet section is formed from a housing with a number of mounted leaf-formed barbed bodies, which can be detached from the tool.

Furthermore, the tool is comprised of an extended casing-shaped element which defines the holding area in the form of a closed chamber or a hollow space.

By using the new device according to the invention, the retrieval of cable/wire remains in a well can occur in a much more effective way, as steadily longer parts of a cable are accumulated in a storage section of the tool, by the mentioned upwards- and downwards movement of the tool. The mouth of the inlet to the storage section comprises barbs which ensure that the cable-string can only be moved one way, namely in towards the storage section when the tool is being moved upwards and downwards.

Thereby, one achieves a reliable placing of the length of cable remains in the storage section so that the rest length can be removed from the well.

Furthermore, as the lower housing part which comprises the mouth of the inlet with the barbed elements easily can be released from the cable-retrieving instrument itself and be replaced by a new housing part with new barbed elements, the instrument becomes, according to the invention, particularly easy to maintain.

Thus, the invention can be used for retrieval of cables/wires/strings and/or cable/string-hanging fittings from drilling holes or wells.

The invention shall now be explained further according to a preferred example, with reference to the subsequent description of the tool and the enclosed FIGS. 1–8.

Figure 1:
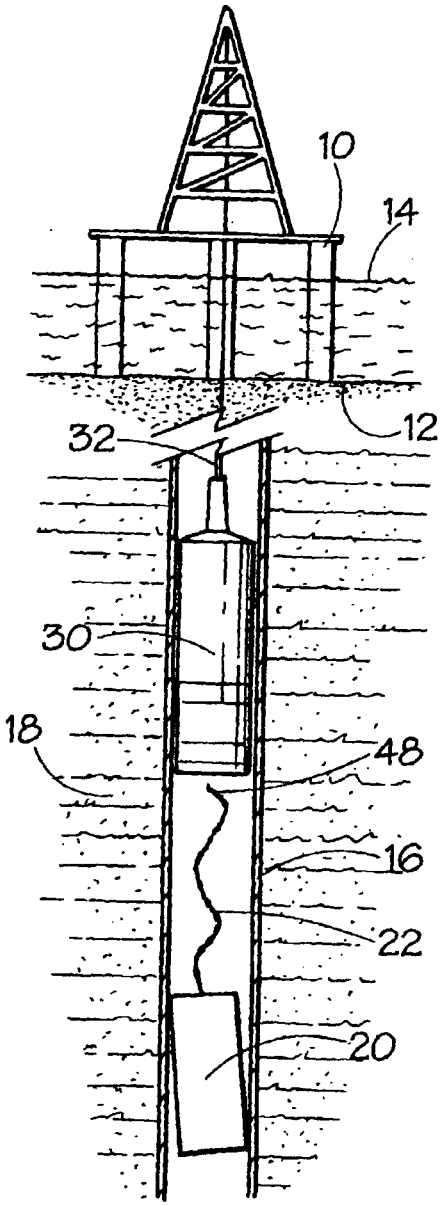
FIG. 1 shows schematically a situation with an oil platform which serves a well down into a formation, and where the cable to a cable-hanging logging instrument is broken and is left behind in the well.

Initially, reference is made to FIG. 1, which shows an example of an environment in which the tool, according to the invention, is used. The figures shall be regarded as non-limiting examples of the invention.

FIG. 1 shows a platform 10 which stands on the ocean bottom 12, lying a certain depth under the ocean surface 14. From the ocean bottom 12, a well 16 leads down to a hydrocarbon containing formation 18.

Down in the well 16, a logging instrument 20 is shown being connected to a cable 22 which lies over the instrument 20. The instrument was previously directed down into the well from the platform 10 suspended in the cable which is now broken. The aim of the invention is to retrieve as much as possible of the cable to the surface, in a shorter time than the previously known appliances could manage.

FIG. 1 also shows the cable-retrieving tool 30, according to the invention, which, suspended mounted at the end of a cable 32 or pipe string, is being lowered down to catch the upper cable length, and then to accumulate as much as possible of the length of cable in the storage section of the instrument, before the tool is hoisted up to the surface.

Figure 2:
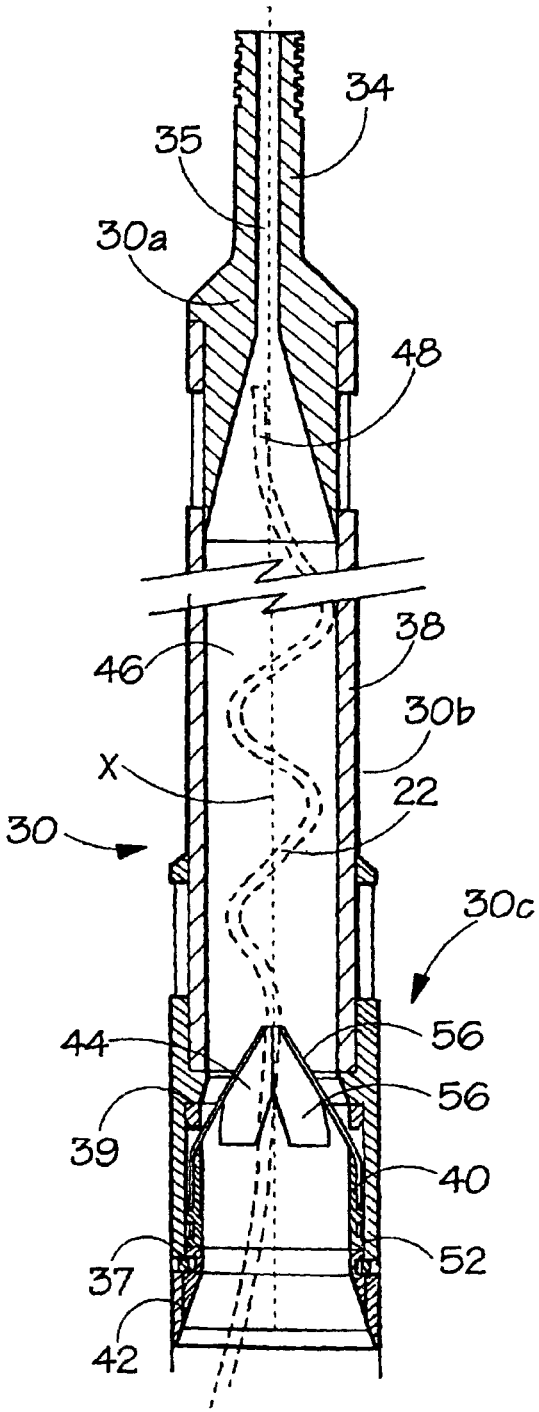
FIG. 2 shows a vertical section of the instrument according to the invention.

FIG. 2 shows a larger cross-section of the instrument 30. This is comprised of an upper section arranged for being attached to the end of the cable or pipe string 32. FIG. 2 shows threads 36 which are used for securing by being screwed into the bottom of the pipe string.

The main part of the instrument 30 comprises an upwards closed and downwards open compartment forming housing part 38. In the downward facing part, a lower detachable housing part 40 is inserted which forms a downward open bell-shaped (dome) 42, while the upper part comprises an inlet mouth 44 which leads into the bottom of the compartment forming (46) housing part 38. The inlet mouth 44 comprises a set of barbed elements. These barbed elements function such that when the instrument 30 is led downwards, then the cable 22 (i.e. first its end part 48) slides easily upwards through the bell-shape, past the barbed elements and will, depending on the stiffness of the cable, be coiled up (i.e. collected/accumulated) more or less in the chamber 46 inside the housing part 38. A cable such as this will be sufficiently stiff so that it easily slides in through the barbed element.

Figure 3:
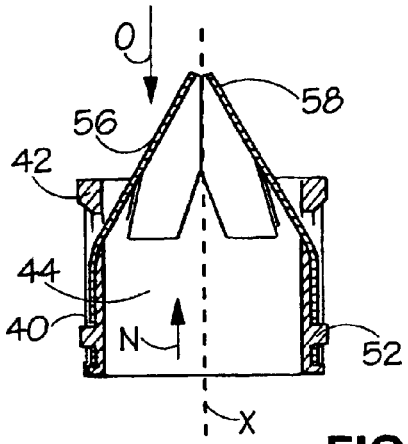
FIG. 3 shows a vertical section of the lower housing part which includes the mouth of the inlet.
Figure 4:
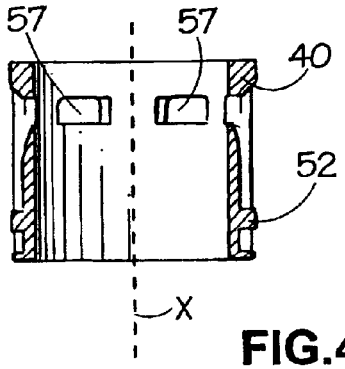
FIG. 4 shows a corresponding vertical section, but with the barbed elements being left out.
Figure 5:
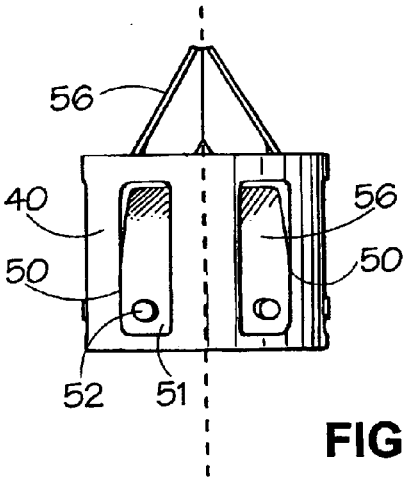
FIG. 5 shows a vertical diagram of the lower housing part, but with the barbed elements fitted.

The FIGS. 3–5 show in detail how the lower housing part 40 is constructed. It comprises a casing, i.e. open both upwards and downwards, which is arranged to be inserted into the bottom of the housing part 38.

The external wall section 42 of the casing 40 comprises a number of longitudinal recesses 41 which are arranged along the periphery of the casing at a given mutual distance between the recesses 50. Uppermost, the recess 41 is rounded inwards so that it breaks through the wall 42, i.e. so that there is a slot 57 through the casing wall 42 uppermost in each recess 50. The lower outwards facing plane part of each recess 50 comprises a radially outwardly extending tap or boss 52.

Figure 6:
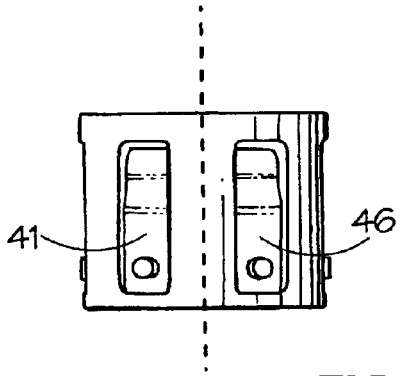
FIG. 6 shows a side view in perspective of the lower housing part.
Figure 7:
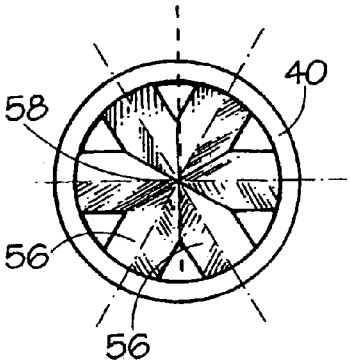
FIG. 7 shows the lower housing part seen from above.

The barb-forming element, mentioned above, is formed by a number of leaf- or plate-formed springs 56 (also called leaf-formed yielding barbed elements). At the one end of each leaf spring 56 is a small hole. The other end of the leaf spring ends in a pointed section 58. The leaf springs 56 are individually placed in their own recess 50 so that the taps stick into their respective holes. The spring is thereby secured in place. The upper part of the spring extends into the central hollow space 44 of the casing 40. The spring is furthermore bent so that it extends inwards and upwards (towards the hollow space) so that the pointed 58 end section extends forward to the longitudinal axis X of the casing. As can be seen in FIG. 6, according to this example, 6 spring elements are inserted around the periphery of the casing, and the pointed end section of the springs are constructed so that their pointed ends meet at one point.

With this construction, the assembly of the 6 springs will make it possible for them to be bent radially outwards when they are subjected to a pressure load from below, marked with the arrow N in FIG. 3. In contrast, they will exert a strong resistance against being bent radially inwards if they are subjected to a pressure load from above, marked by the arrow O in FIG. 3. Thereby, the assembly works according to the barb principle, i.e. that a body will easily be directed into the casing and upwards through the mouth section as the springs simultaneously bend outwards and thus let the body through the mouth upwards in the direction of the arrow N. If one tries to pull the body downwards in the direction of the arrow O, the spring ends squeeze tightly around the body and prevent it from being pulled out.

How much stretching power the tool can tolerate depends on the strength of the barbed segment. The thicker the plate-formed leaves 56 are, the greater the stretching strength will be. The stretching strength/lifting ability of the barbed segment can, of course, be varied by varying the leaf thickness. With leaves of a thickness of about 1 mm (millimeter), the tool can lift about 100 kg, whilst with a thickness of about 3 mm the lifting ability can be increased to 3–4 tonnes.

Figure 8:
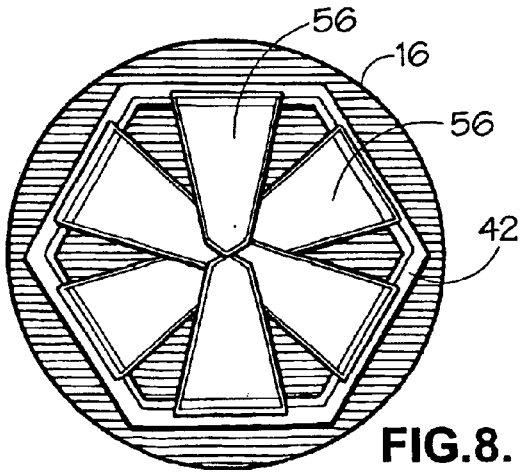
FIG. 8 shows an alternative of the lower housing part seen from above.

FIG. 8 shows a diagram of an alternative of the replaceable casing part. The well wall/lining is shown by 16 and the casing has a hexagonal cross-section. The seating inside the apparatus in which the casing is placed, has then a corresponding hexagonal cross-section so that the parts fit approximately exactly together. It can be seen that the leaf springs do not completely cover the cross-section when the casing is viewed from above. Furthermore, the leaves overlap each other at their pointed ends.

At the bottom of FIG. 2 it is shown how such a casing part casing 40 is secured to the bottom part of the housing 38. The outer contour of the casing corresponds to the inner contour of bottom section of the housing 38, as the upper part of the casing wall is brought to push against a lip 39 inside the housing part. The casing 40 is secured to the housing part 38 with the aid of a locking pin which, for example, can be screwed into a threaded hole in the wall of the housing 38 and further into a recess in the outer wall of the casing. The replacement is effected by the locking pin being unscrewed, the casing being pulled out, and the plate-formed leaf springs being maintained or being replaced, if desired.

It will appear from FIG. 2 that the inner, open diameter of the lower part of the casing increases gradually downwards, so that the upper part 48 of a cable end 22 can more easily be conducted into the hollow space 44 of the casing and come into engagement with the barbed leaf springs 56.

The internal chamber in the housing part 38 is adapted to take up and accumulate lengths of wire which are forced up through the mouth section. When a length of wire shall be brought up with the aid of the instrument according to the invention, it is being directed, suspending in the wire 32, downwards into the well so that the cable length 22 enters the inlet and advances into the chamber 46. From the surface, the instrument is now conducted upwards and downwards so that the wire gradually accumulates inside the chamber. If a logging instrument is still hanging at the end of the wire, this will probably come up to the surface as the wire 34 is lifted up towards the surface.

The upward movement of the tool will lead to the wire suspended under the tool being straightened out and stretched, and thus contributes to the wire having a more longitudinal and straight position in the well. This will ease its passage through the barbed segment when the tool is lowered during the next stage.

Both the cross-section and length of the tool can, of course, be varied and adapted to current well dimensions, and with respect to the type of equipment (wires/cables) to be brought up from the well. Therefore, the tool, according to the invention, can be constructed so that the holding area has a length of from about 1 meter and up to 10 meters. The longer the tool/holding area is, the longer the length of cable which can be handled. One embodiment of this is shown in FIG. 2 which shows the tool divided in three parts, an upper section 30*a*, a middle section 30*b* and a lower section 30*c* (incorporating the lower housing section). This is to suggest that the tool can be separated into these three sections, as the middle section 30*b* can be replaced with middle sections of different lengths, so that the total length of the apparatus can vary, i.e. the length to its holding area 46 is in the range 1–10 meters.

The apparatus according to the invention comprises an inner through-going channel 35 (see FIG. 2) which forms a fluid connection with a channel through which fluid can flow through the pipe string in which the apparatus is hanging.

What is claimed is:

1. A method for retrieving a cable from a well comprising the steps of providing a tool with an inlet mouth, barbed means above the inlet mouth for permitting passage of a cable in one direction and for preventing passage of the cable in an opposite direction and a hollow holding area above the means;

lowering the tool into a well having a cable therein;

passing the tool over the cable to allow an end of the cable to pass through the inlet mouth and the barbed means into the hollow holding area; and thereafter moving the tool downwardly and upwardly to move a further length of the cable into the holding area while preventing the length of cable in the holding area from passing out of the holding area.

2. A method as set forth in claim 1 wherein the cable extending under the tool is straightened and stretched in response to each upward movement of the tool.

3. A method as set forth in claim 1 wherein the barbed means includes a plurality of yielding leaf springs, each of the leaf springs having one end spaced from and parallel to a longitudinal axis of the inlet mouth and a second pointed end bent inwardly towards said axis and at least meeting an adjacent leaf spring pointed end.

4. A tool for retrieving a cable from a well comprising an inlet mouth for passing over an end of a cable in a well;

barbed means above said inlet mouth for permitting passage of the cable in one direction and for preventing passage of the cable in an opposite direction, said barbed means including a plurality of yielding leaf springs, each of said leaf springs having one end spaced from and parallel to a longitudinal axis of said inlet mouth and circumferentially spaced from an adjacent leaf spring, and a second end bent inwardly towards said axis and having a pointed end for gripping a cable thereat with each pointed end of a respective leaf spring overlapping an adjacent leaf spring; and a hollow holding area above said means for receiving and accumulating therein a cable gripped between said pointed ends of leaf springs.

* * * * *